United States Patent [19]

Park

[11] Patent Number: 4,457,956

[45] Date of Patent: Jul. 3, 1984

[54] METHOD FOR AUTODEPOSITION ONTO A NON-METALLIC SURFACE

[75] Inventor: Kisoon Park, Charleston, W. Va.

[73] Assignee: Union Carbide Corporation, Danbury, Conn.

[21] Appl. No.: 176,770

[22] Filed: Aug. 11, 1980

[51] Int. Cl.[3] ..... B05D 1/36

[52] U.S. Cl. ..... 427/203; 427/302; 427/407.1; 427/412.1; 427/419.8; 427/435

[58] Field of Search ..... 204/20, 30, 181 T; 427/203, 435, 302, 407.1, 412.1, 419.8

[56] References Cited

U.S. PATENT DOCUMENTS

| | | | |
|---|---|---|---|
| 1,527,241 | 2/1925 | Warren | 204/30 |
| 3,099,572 | 7/1963 | Rion et al. | 427/302 |
| 3,218,191 | 11/1965 | Domanski | 427/302 |
| 3,585,084 | 6/1971 | Steinbrecher et al. | 427/435 |
| 3,674,671 | 7/1972 | Stromberg | 204/181 T |
| 3,775,176 | 11/1973 | Cross et al. | 204/30 |
| 3,865,617 | 2/1975 | Shimizu et al. | 427/435 |
| 4,103,049 | 7/1978 | Nishida et al. | 427/435 |

OTHER PUBLICATIONS

Gerhart et al., Am. Chem. Society Preprint Booklet, Symposium/Workshop of Organic Coatings and Plastics Division, ACS Meeting Mar. 20–25, 1977, New Orleans; pp. 405–408.

Prieve et al., Ind. Eng. Chem. Prod. Res. Dev., vol. 17, No. 1, 1978.

*Primary Examiner*—Michael R. Lusignan
*Assistant Examiner*—Richard Bueker
*Attorney, Agent, or Firm*—Bernard Francis Crowe

[57] ABSTRACT

A method which allows autodeposition onto a non-metallic surface wherein a metallic powder is applied to the non-metallic surface followed by application of an autodeposition coating.

6 Claims, No Drawings

METHOD FOR AUTODEPOSITION ONTO A NON-METALLIC SURFACE

BACKGROUND OF THE INVENTION

Autodeposition, also known as autophoresis ® or chemiphoresis, is a process for depositing an organic coating on a metal surface. The process involves the controlled release of multivalent metal ions from the metal surface which destabilizes dispersed polymer particles in the coating such that coating builds up on the metal surface. Such systems are well known in the coating art and are described in for example, U.S. Pat. Nos. 3,776,848, 3,791,431, 4,108,817, 3,839,097, 3,829,371 and 4,104,424.

Autodeposition, though a relatively new procedure for coating metal surfaces, has achieved considerable importance and wide use in the coating industry due to its many advantages over conventional systems, such as electrolytic deposition. By using autodeposition, practitioners of the art can now deposit an inorganic and an organic film simultaneously with fewer operating steps in less time while utilizing less floor space than conventional pretreatment/ electrocoating systems. Autodeposition also reduces the air and water pollution associated with conventional coating systems because organic solvent usage is minimized. The use of autodeposition also reduces significantly the energy usage required by certain conventional electrocoating systems. A further advantage is the sharply decreased safety risk attained by avoiding the use of electric current in the coating bath.

A major disadvantage of autodeposition coating is the inability to coat non-metallic surfaces with autodeposition coating systems since autodeposition requires some dissolution of the metal substrate to be coated to furnish metal ions to the autodeposition coating bath; furnishing of metal ions to the coating bath is essential to the autodeposition process. Thus it has heretofore been virtually impossible to autodeposit a coating onto such substrates as wood, ceramic, glass, plastic, etc. Further it has also heretofore been virtually impossible to autodeposit a coating onto any substrate, metallic or otherwise, on which there has been previously coated a non-metallic coating such as a polymeric coating.

This severe disadvantage has greatly hampered the utility of autodeposition systems and greatly restricted the uses and applications to which autodeposition could be put. Therefore, a method which would allow autodeposition onto a non-metallic surface would be of great utility and would be highly advantageous.

SUMMARY OF THE INVENTION

It has now been found that coatings can be autodeposited onto non-metallic surfaces by use of a method wherein metal, metal salt, or metal oxide powder is deposited onto the non-metallic surface before the autodeposition coating is applied.

DESCRIPTION OF THE INVENTION

In the process of this invention the non-metallic surface which is to be coated by autodeposition is first coated with a thin layer of a metal powder, a metal salt powder, or a metal oxide powder, and herein all are called for convenience metallic powder. The thus treated surface is then coated by conventional autodeposition procedures.

The metallic powder useful in the process of this invention is composed of finely divided particles. The particles must have a sufficiently large surface area in relation to the particle weight in order to facilitate the rapid release of multivalent cations to the autodeposition coating mixture. The average particle size of the metallic powder is from 0.5 to 50 microns and preferably it is from 0.5 to 25 microns.

The metallic powder is essentially a finely ground metal compound which is capable of furnishing multivalent cations to the autodeposition coating mixture. The term metal compound is used throughout this application to represent a metal, a polyvalent metal salt or a polyvalent metal oxide or hydroxide or mixtures thereof. Illustrative of the metal compounds which can be employed as metallic powders one can name iron, aluminum, zinc, cadium, zirconium, antimony, magnesium, vanadium, manganese, aluminum acetate, aluminum chloride, aluminum sulfate, zinc acetate, magnesium chloride, zirconium nitrate, cadmium chloride, cadmium sulfate, ferric perchlorate, the oxides and hydroxides of iron, chromium, vanadium, molybdenum, manganese, zirconium, zinc, cobalt, cadmium, and tin, as well as any other metallic compounds that are capable of releasing multivalent cations when brought into contact with an acidic aqueous solution. Among the preferred metal compounds one can mention aluminum acetate, zinc acetate, ferric chloride, zinc, zinc oxide, iron, and ferric acetate; particularly preferred is aluminum acetate.

Of course, mixtures of the metal compounds can also be used to make up the metallic powder.

The metallic powder is applied to the non-metallic surface in a thin layer; it is desirable that the layer of metallic powder not be much greater than one particle diameter in thickness. The layer of metallic powder should be as thin as practicable in order to facilitate the rapid release of multivalent cations to the autodeposition coating mixture. The metallic power layer should also be as uniform as practicable. The uniformity of the metallic powder layer aids in the attainment of a smoother and therefore glossier and more attractive autodeposited coating.

The metallic powder may be applied to the non-metallic surface by any means useful for applying a dry powder, i.e. substantially free of water, to a substrate. Among such useful means one can name fluidized bed, compressed-gas gun, electrostatic powder coating device and other techniques well known to those skilled in the art.

The metallic powder can be applied to any non-metallic surface. Among the very many such non-metallic surfaces one can name plastic, wood, glass, ceramic, cloth, etc. Furthermore, any substrate metallic or non-metallic, which has been previously coated with a non-metallic coating, such as a polymeric coating, can also be coated by use of the process of this invention.

The metallic powder, upon application to the non-metallic surface, must adhere to the non-metallic surface at least for a period of time sufficient to allow application of the autodeposition coating. Any method which will effectively adhere the metallic powder to the non-metallic surface and which also will not substantially hinder the release of multivalent cations from the metallic powder to the autodeposition mixture is useful in the practice of the process of this invention.

When the non-metallic surface which is to be coated by use of the autodeposition process of this invention is thermoplastic in nature, a convenient method of effecting the adhesion of the metallic powder to this thermoplastic non-metallic surface is to have the surface in a slightly thermoplastic condition, i.e. tacky, when the metallic powder is to be applied. This technique is applicable both when the entire substrate is a thermoplastic material or when only the surface of the substrate is thermoplastic. Among the very many such thermoplastic materials one can mention homo- and copolymers of ethylene, propylene, vinyl chloride, vinylidene chloride, methyl acrylate, butyl acrylate, styrene, butadiene, ethyl acrylate, acrylic acid, methacrylic acid, methyl methacrylate, 2-ethyl hexyl acrylate, vinyl acetate, isobutylene, acrylonitrile, as well as any of the other monomers known to those skilled in the art, and such condensation polymers as polyethylene terephthalate and hexamethylene diamime adipate, and the like. The thermoplastic non-metallic surface may be rendered into the thermoplastic condition in any way practicable. One useful means is to heat the surface to a temperature between its glass transition temperature and its melting temperature. Another way, which is applicable when the non-metallic surface is a previously deposited coating, is to apply the metallic powder directly after the bake cycle while the surface still exhibits some surface tack. Still another method is to apply a suitable solvent to the surface to render it slightly tacky. In this regard, among the solvents suitable one can name toluene, acetone, hexane, isopropanol, methylethyl ketone, tetrahydroxyfuran, trichloroethylene, and the like. When a solvent is so used, any excess should be removed before the application of the autodeposition coating so that any adverse effect on the close contact between metallic powder and non-metallic surface is minimized.

After the metallic powder has been applied to the non-metallic surface, the autodeposition coating is applied. This can be accomplished by known procedures, disclosed in, for example, U.S. Pat. Nos. 3,776,848, 3,791,431, 4,108,817, etc. As is known the autodeposition coating composition contains an acidic compound in an amount sufficient to provide a pH to the composition of less than 5, preferably 2 to 3. Illustrative of such compounds one can name hydrofluoric acid, hydrochloric acid, formic acid, acetic acid, sulphuric acid, nitric acid, phosphoric acid, hydrobromic acid, hydroiodic acid, chloroacetic acid, trichloroacetic acid, lactic acid, tartaric acid, polyacrylic acid, and the like. The preferred acid is hydrofluoric acid.

The autodeposition coating composition also contains from 2 to 20 weight percent, preferably from 5 to 15 weight percent of resinous coating materials. The resinous coating material is provided to the autodeposition coating in the form of an aqueous dispersion or latex. Virtually any resin materials which are capable of producing autodeposition coatings can be used and illustrative of these materials one can name homo- and copolymers of ethylene, butadiene, ethyl acrylate, butyl acrylate, 2-ethyl hexylacrylate, butyl methacrylate, vinyl chloride, vinylidene chloride, methyl methacrylate, acrylonitrile, acrylic acid, methacrylic acid, styrene and the like.

The autodeposition coating also contains oxidizing agents in an amount sufficient to provide an oxidizing equivalent of at least 0.01 per liter of coating composition, preferably from 0.1 to 0.2. The upper equivalent value is not critical, and can be as high as one equivalent, or higher, per liter of the coating bath. The oxidizing agents are well known to those skilled in the art and many are described in, for example, U.S. Pat. No. 4 030,945. Illustrative of the many suitable oxidizing agents one can name hydrogen peroxide, sodium or potassium permanganate, perborate, bromate nitrite, nitrate, chlorate, and the like. A preferred oxidizing agent is hydrogen peroxide.

A preferred autodeposition composition contains fluoride ion in a concentration of from 0.1 to 20 grams per liter, preferably from 2 to 8 grams per liter. A particularly preferred autodeposition composition contains ferric fluoride in a concentration of from about 1 to about 5 grams per liter.

The autodeposition coating can also contain other additives commonly employed in autodeposition coatings. These additives are well known to those skilled in the art as are the concentrations in which they are normally present if employed and these additives include pigments, film aids, crosslinking agents, surfactants and other dispersing aids, protective colloids, levelling agents, foam control agents, auxiliary stabilizers, and the like.

The balance of the autodeposition coating composition, in sufficient amount such that the previously described concentration of components are attained, is composed of water.

The autodeposition coating is applied to the metallic powder coated non-metallic surface using conventional autodeposition techniques which are well known to those skilled in the art and need no further elucidation here. The coating is applied to the surface for a period of time such that the desired coating forms on the surface. The autodeposition coating can be cured in any way practicable; a convenient and often used method is baking. Again those skilled in the art are fully familiar with these techniques.

As the autodeposition coating is applied to the metallic powder coated non-metallic surface, the metallic powder is dissolved releasing multivalent metal cations to the autodeposition coating which destabilize the coating composition and cause the solid resinous coating material to autodeposit; thus autodeposition is effected directly upon the non-metallic surface.

By use of the novel process of this invention one can now autodeposit coatings on many surfaces which heretofore could not be coated by means of autodeposition. Thus one can now autodeposit directly onto plastic substrates or surfaces, or onto other non-metallic substrates or surfaces such as wood, glass or ceramic. Further one can coat these non-metallic substrates or surfaces with a polymeric coating by any means available, and, by use of the process of this invention, one can now autodeposit upon this coated non-metallic substrate or surface. Still further one can coat metallic substrates with a polymeric coating, using autodeposition or any other method, and, by use of the process of this invention, one can now autodeposit upon this polymeric coated metallic substrate. As is evident from the above, the novel process of this invention greatly extends the many benefits of autodeposition to many applications and surfaces heretofore thought incompatible with autodeposition systems. Applicant has solved a longstanding problem in the autodeposition art by means of a novel and completely unobvious process; this process could not have been predicted from the prior art.

The following examples serve to further illustrate the invention; they are in no way intended to limit the invention.

EXAMPLE 1

Preparation of Acid Solution

To a plastic beaker there was charged 1134 ml of an aqueous 21 percent hydrofluoric acid solution. With vigorous agitation of the beaker contents there was added to the beaker, gradually over a six hour period, 90 grams of iron powder followed by the addition of 900 ml of distilled water and continued agitation overnight. There was then added with stirring, 96 ml of 30 percent hydrogen peroxide solution at a rate of 1 ml per minute followed by the addition of distilled water so as to bring the total solution volume to 3000 ml. The solid reaction residue, which was essentially undissolved iron powder, was removed by filtration. This solution was then diluted to about 5 percent by weight with distilled water to prepare a deposition medium hereinafter referred to as the acid solution.

Preparation of Coating Mixture

There were charged to 2000 ml beaker 250 grams of acid solution and 244 grams of a 41 percent by weight styrene/butyl acrylate methacrylic acid latex; there was then added distilled water in an amount such that the total weight of the mixture was 1000 grams. The latex solids concentration was thus 10 weight percent.

Initial Coat

A cold-rolled steel panel measuring 12.5×7.5×0.1 cm was cleaned by immersing it in a dilute solution of an alkaline detergent solution containing phosphate and non-ionic surfactants at 150° F. for two minutes followed by a deionized water spray rinse. The panel was then dipped in a bath of the coating mixture at ambient temperature for 1 minute, and rinsed for 30 seconds with a solution of sodium dichromate which contained 0.3 weight percent of chromium compound as $Na_2Cr_2O_7.2H_2O$. The rinsed, coated panel was placed in an oven with moderate air flow and the coating was baked for 15 minutes at 160° C. The coating was about 0.5 mil in thickness.

Coating on Non-metallic Surface

The coated panel was removed from the oven after the baking procedure described above. While the coating was still hot and tacky, a thin coating of zinc powder having an average particle size of about 5 microns was applied to the hot and tacky coating on one side of the panel by use of a sand blaster gun using compressed air at 35 psi; the reverse side was left untreated. The panel was then allowed to cool at ambient conditions for a few minutes.

To the coating mixture prepared above there was added an aqueous dispersion of carbon black in a concentration of 5 grams per liter so as to better observe the uniformity of the coating when applied. The panel prepared above was then dipped for 60 seconds in the carbon black coating mixture while undergoing a slow stroking motion of about 10 traverses per minute. The panel was removed from the coating bath and placed in the same oven used above for 15 minutes at 160° C. Upon removal from the oven the side of the panel which had undergone the metallic powder coat displayed a uniformly black,smooth, glossy surface, wherein the second coat was about 1.2 mil in thickness. The untreated side of the panel which had not been treated with the metallic powder had no carbon black coating adhering to it.

The results of this example clearly demonstrate that by use of the process of this invention one can now autodeposit a coating onto a non-metallic surface onto which it has heretofore not been possible to autodeposit.

EXAMPLE 2

Using the acid solution, coating mixture and carbon black coating mixture prepared in Example 1, a steel panel was coated following the procedure of Example 1 except that aluminum acetate powder having an average particle size of about 10 microns was used instead of the zinc powder and the panel was dipped in the carbon black coating mixture for only 15 seconds. The resulting coating was uniformly black, smooth and glossy and had a thickness of about 1 mil. The total coating on the steel panel i.e. initial coat and carbon black coat amounted to about 2 mils.

EXAMPLE 3

Using the acid solution, coating mixture and carbon black coating mixture prepared in Example 1, a steel panel was coated following the procedure of Example 1 except that iron powder having an average particle size of about 10 microns was used instead of the zinc powder. The resulting coating was uniformly black, smooth and glossy and had a thickness of about 1.2 mils. The total coating on the steel panel amounted to about 2 mils.

EXAMPLE 4

Using the acid solution, coating mixture and carbon black coating mixture prepared in Example 1, a steel panel was coated following the procedure of Example 1 except that aluminum powder having an average particle size of about 10 microns was used instead of the zinc powder. The resulting coating was uniformly black, smooth and glossy and had a thickness of about 1 mil. The total coating on the steel panel amounted to about 2 mils.

What is claimed is:

1. A method of applying an autodeposition coating onto a non-metallic surface comprising, in order, the steps of:
   (A) Depositing onto said non-metallic surface a layer of powder of aluminum acetate wherein the powder has an average particle size of from 0.5 to 50 microns and is capable of releasing multivalent cations when brought into contact with an acidic aqueous solution;
   (B) applying to the resulting metal compound coated non-metallic surface of step (A) an aqueous autodeposition coating having a pH of less than 5 and comprised of from 2 to 20 weight percent of resinous coating material and an oxidizing agent in an amount sufficient to provide an oxidizing equivalent of at least 0.01 per liter of said autodeposition composition, for a period of time such that a covering forms on the non-metallic surface; and
   (C) curing the coating applied to said surface.

2. A method as claimed in claim 1 wherein said aluminum acetate has an average particle size of from 0.5 to 25 microns.

3. A method as claimed in claim 1 wherein said non-metallic surface is a polymeric coating.

4. A method as claimed in claim 1 wherein aqueous autodeposition coating has a pH of from 2 to 3.

5. A method as claimed in claim 1 wherein said resinous coating material is present in a said aqueous autodeposition coating in a concentration of from 5 to 15 weight percent.

6. A method as claimed in claim 1 wherein said resinous coating material is a homopolymer or copolymer comprising polymerized ethylene, butadiene, ethyl acrylate, butyl acrylate, 2-ethylhexyl acrylate, butyl methacrylate, vinyl chloride, vinylidene chloride, methyl methacrylate, acrylonitrile, acrylic acid, methacrylic acid or styrene.

* * * * *